US007632044B2

(12) United States Patent
Pallini et al.

(10) Patent No.: US 7,632,044 B2
(45) Date of Patent: Dec. 15, 2009

(54) RAM STYLE TENSIONER WITH FIXED CONDUCTOR AND FLOATING FRAME

(75) Inventors: Joseph W. Pallini, Tomball, TX (US); Edward A. Mendoza, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 152 days.

(21) Appl. No.: 11/970,974

(22) Filed: Jan. 8, 2008

(65) Prior Publication Data

US 2008/0166186 A1 Jul. 10, 2008

Related U.S. Application Data

(60) Provisional application No. 60/879,275, filed on Jan. 8, 2007.

(51) Int. Cl.
*E21B 19/00* (2006.01)

(52) U.S. Cl. ..... 405/224.4

(58) Field of Classification Search ..... 405/224.4, 405/224.3, 224.2, 223.1; 166/367
See application file for complete search history.

(56) References Cited

U.S. PATENT DOCUMENTS 4,787,778 A * 11/1988 Myers et al. ..... 405/224.4
5,551,803 A 9/1996 Pallini, Jr. et al.
6,746,182 B2 6/2004 Munk et al.
7,112,011 B2 * 9/2006 McCarty et al. ..... 405/224.4
7,329,070 B1 2/2008 Trent et al.
2005/0074296 A1 * 4/2005 McCarty et al. ..... 405/224.4
2005/0123359 A1 * 6/2005 McCarty et al. ..... 405/224.4
2005/0147473 A1 7/2005 Pallini et al.
2007/0048094 A1 * 3/2007 Mao et al. ..... 405/224.4
2008/0205992 A1 * 8/2008 Ellis et al. ..... 405/224.4

* cited by examiner

*Primary Examiner*—Frederick L Lagman
(74) *Attorney, Agent, or Firm*—Bracewell & Giuliani

(57) ABSTRACT

A riser tensioner for an offshore floating platform has a frame stationarily mounted to the upper portion of the riser. Pistons and cylinders are spaced circumferentially around the riser and connected between the frame and the floating platform. A tubular guide member is mounted to the floating platform for movement in unison in response to waves and currents. The riser extends through the guide member. A guide roller support is mounted to and extends downward from the frame around the guide member. At least one set of guide rollers is mounted to the guide roller support in rolling engagement with the guide member as the guide member moves in unison with the platform.

9 Claims, 3 Drawing Sheets

RAM STYLE TENSIONER WITH FIXED CONDUCTOR AND FLOATING FRAME

CROSS-REFERENCE TO RELATED APPLICATION

This application claims priority to provisional patent application 60/879,275, filed Jan. 8, 2007.

FIELD OF THE INVENTION

This invention relates generally to tensioner assemblies and in particular to a riser tensioner assembly associated with a riser extending from subsea well equipment to a floating platform.

BACKGROUND OF THE INVENTION

A floating production platform is often used for deep water offshore oil and gas production. One or more risers extend from subsea equipment on the sea floor, such as a manifold or subsea production tree. The riser extends through an opening in the platform. A riser tensioner is mounted on the platform to apply and maintain tension in the riser.

The tensioner typically comprises a plurality of pistons and cylinders mounted between the platform and a frame secured to the riser. Fluid pressure is applied to the cylinders to apply tension to the riser. The platform moves toward and away from the subsea equipment in response to waves and currents. The riser, of course, is relatively stationary at the surface, so the movement of the platform causes the pistons and cylinders to stroke inward and outward.

To avoid damage to the riser due to platform movement, guide rollers may be employed to engage the riser or a conductor pipe surrounding an upper portion of the riser. The guide rollers are typically mounted to the platform for movement in unison with the platform.

SUMMARY

The riser tensioner has a frame stationarily mounted to the upper portion of the riser. A plurality of pistons and cylinders are mounted between the frame and the floating platform. The cylinders are supplied with a pressurized fluid to apply tension to the riser. A guide member is mounted to the floating platform for movement in unison in response to waves and currents. A bearing support is stationarily mounted to and extending from the frame. A bearing is mounted to the bearing support in movable engagement with the guide member as the guide member moves in unison with the platform. In the preferred embodiment, the bearing comprises a set of rollers. The guide member and the guide roller or bearing support are in telescoping relation ship with one another.

In the embodiment shown, the guide member is tubular, and the riser extends through the guide member. In this embodiment, the platform has an upper deck and a lower deck. The piston and cylinders are mounted to the upper deck. The guide member is mounted to the lower deck and extends upward through an opening in the upper deck.

DETAILED DESCRIPTION OF THE INVENTION

Figure 1:
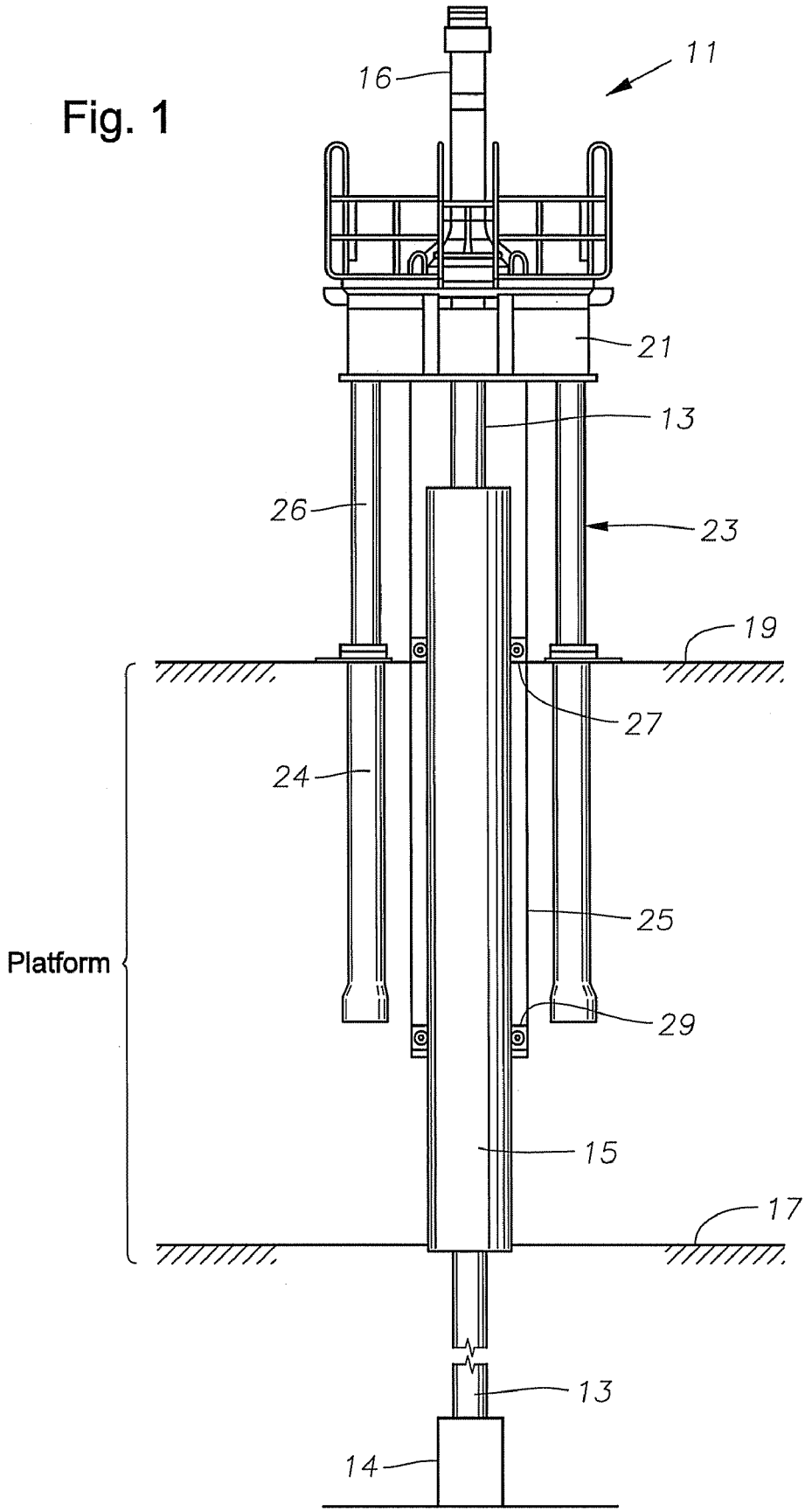
FIG. 1 is a schematic view of a riser tensioner assembly, built in accordance with the present invention, and in an intermediate position.

Referring to FIG. 1, a riser tensioner assembly 11 is associated with a riser 13 extending between subsea well equipment 14 on the sea floor and a floating production facility or platform at the surface. The subsea well equipment 14 may be a subsea wellhead, production tree, manifold or other facilities for conveying well fluids to the floating production facility. The lower end of riser 13 is stationarily mounted to subsea well equipment 14. Riser 13 is fixed in length and extends upward from subsea well equipment 14 through an opening in the floating platform.

In this embodiment, riser 13 extends through a conductor or guide member 15 mounted stationarily on the production facility. Guide member 15 is preferably tubular and has an inner diameter larger than an outer diameter of riser 13. Riser 13 extends above guide member 15 to a riser mandrel 16 for interfacing with equipment on the production facility. The lower end of guide member 15 may be located at the bottom of the floating production facility.

The platform preferably includes a lower deck 17 that is rigidly connected to guide member 15 such that guide member 15 is stationary relative to lower deck 17 and the rest of the platform. The platform also has an upper deck 19 that is a fixed distance from lower deck 17. In this example, upper deck 19 serves as a base for riser tensioner assembly 11 to actuate from.

Figure 2:
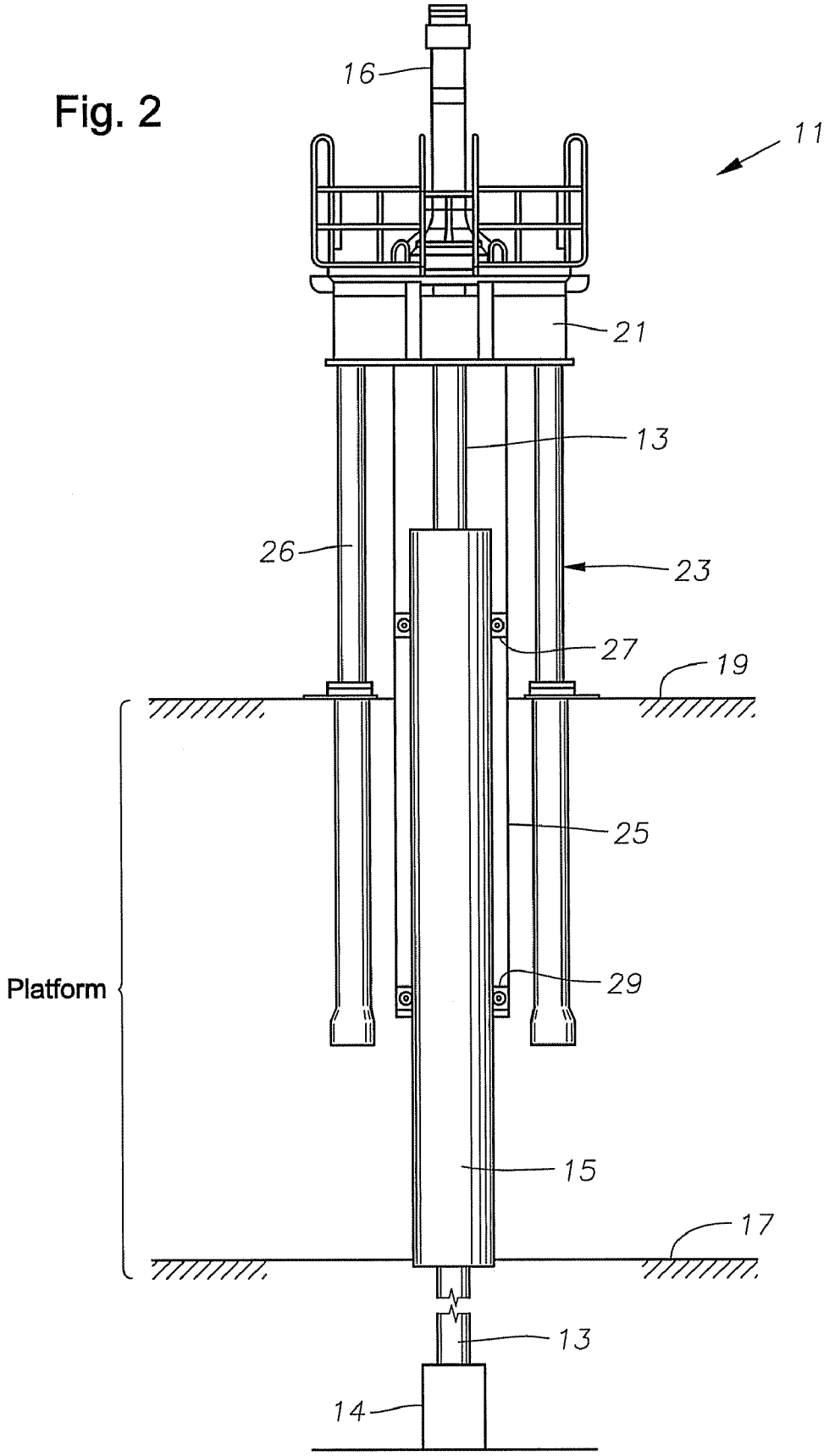
FIG. 2 is a schematic view of the riser tensioner assembly of FIG. 1, in an extended position.
Figure 3:
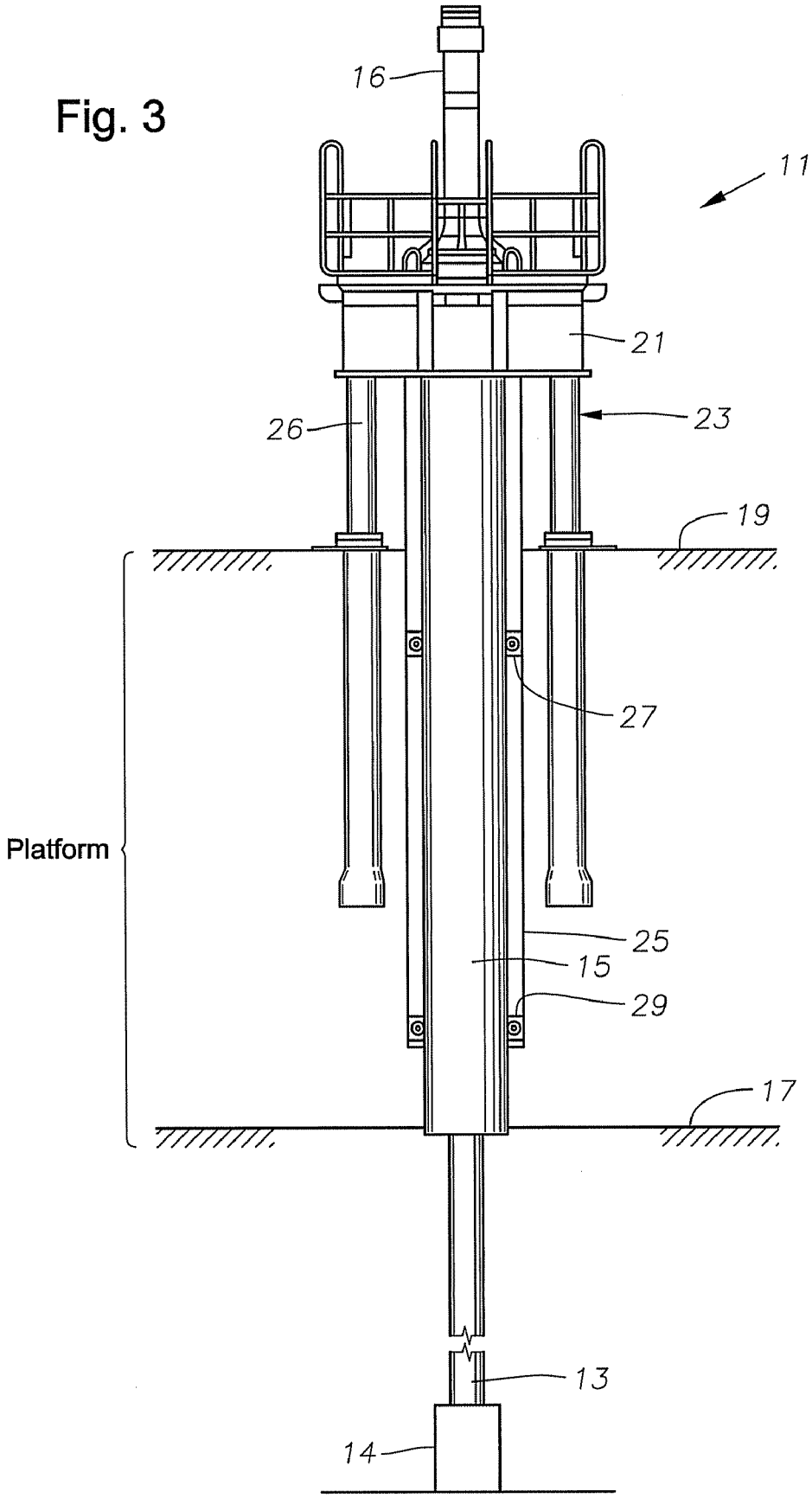
FIG. 3 is a schematic view of the riser tensioner assembly of FIG. 1, in a retracted position.

Riser tensioner assembly 11 preferably includes a top frame 21 positioned above upper deck 19 and stationarily mounted to riser mandrel 16. A plurality of hydro-pneumatic cylinder assemblies 23 extend axially downward from frame 21 and connect to upper deck 19. In the preferred embodiment, cylinder assemblies 23 are circumferentially spaced around riser 13. Each cylinder assembly 23 comprises a cylinder or cylinder 24 and a piston 26 such that cylinder assemblies 23 actuate between an extended position as shown in FIG. 2 and a retracted position as shown in FIG. 3. Preferably each cylinder 24 is mounted stationarily to upper deck 19 and the upper end of each piston 26 is mounted to frame 21. However, that arrangement could be reversed. Cylinder assemblies 23 exert an upward tensile force on riser 13 and help to alleviate changes in axial loads on riser 13 due to movement of the production facility toward and away from subsea equipment 14 in response to waves and currents.

A guide roller or bearing support 25 extends downward from frame 21 around an upper portion of guide member 15. In the example shown, guide roller support 25 comprises frame members or braces spaced circumferentially apart from each other. Each brace extends parallel with an axis of guide member 15. Alternately, guide roller support could be tubular in order to receive and surround a portion of guide member 15. Guide roller support 25 has a lower end that is spaced above the lower end of guide member 15, even during a minimum stroke position, as shown in FIG. 3. Guide roller support 25 is rigidly connected to frame 21 such that guide roller support 25 is stationary with frame 21 and riser 13. Decks 17, 19 and guide member 15 move axially upward and downward relative to guide roller support 25.

Upper and lower bearings 27, 29 are mounted to guide roller support 25 for rolling engagement with the exterior of guide member 15. Each bearing is preferably a set of rollers 27, 29, which comprises a plurality of rollers spaced circumferentially around guide member 15. Upper and lower rollers 27, 29 aid in the movement of guide member 15 relative to guide roller support 25 as guide roller support 25 moves axially upward and downward relative to guide roller support 25. In the preferred embodiment, rollers 27, 29 are axially spaced apart and mounted on the inner side of guide member 15. Axially spacing apart rollers 27, 29 helps to distribute forces from guide member 15 to guide roller support 25 so that riser tensioner assembly 11 transfers moment forces associated with movements of the production facility through guide member 15 and guide roller support 25 rather than directly to riser 13.

FIG. 1 shows tension assembly 11 in an intermediate position, with pistons 26 partly extended and frame 21 spaced above the upper end of guide member 15. In FIG. 2, the production vessel has moved downward or closer to the subsea well equipment 14 from the position in FIG. 1. Because riser mandrel 16 is stationary, pistons 26 have extended from the position in FIG. 1. The upper end of guide member 15 is farther from frame 21 than in FIG. 1. The upper end of guide member 15 is closer to the upper set of rollers 27 than in FIG. 1.

In FIG. 3, the production vessel has moved farther from the subsea well equipment 14 due to waves or current. Pistons 26 have contracted and the upper end of guide member 15 is substantially in contact with frame 21. Guide member 15 has moved upward such that the lower set of rollers 29 is now engaging guide member 15 near its lower end.

Although some embodiments of the present invention have been described in detail, it should be understood that various changes, substitutions, and alterations can be made hereupon without departing from the principle and scope of the invention. For example, rather than guide rollers to serve as the bearings, bushings could be used. Also, rather than a single, central guide member that receives the riser, a plurality of offset guide members could be employed. These offset guide members would not receive a riser, rather they would be mounted circumferentially around the riser, such as between some of the cylinder assemblies. A mating upper guide roller set would be mounted to the top frame for each offset guide member. In that instance the offset guide members would extend through the upper end of the top frame.

The invention claimed is:

1. An offshore facility, having a floating platform, a riser having a lower end secured to subsea equipment and an upper portion extending through an opening in the platform, an improved riser tensioner, comprising:

a frame stationarily mounted to the upper portion of the riser;

a plurality of pistons and cylinders spaced circumferentially around the opening, each piston and cylinder being mounted between the frame and the floating platform, the cylinders being supplied with a pressurized fluid to apply tension to the riser;

a tubular guide member mounted to the floating platform for movement in unison in response to waves and currents, the riser extending through the guide member;

a guide roller support stationarily mounted to and extending downward from the frame around the guide member; and at least one set of guide rollers mounted to the guide roller support, spaced circumferentially around the guide member and in rolling engagement with the guide member as the guide member moves in unison with the platform.

2. The facility according to claim 1,wherein:

the platform has an upper deck and a lower deck; the frame is located above the upper deck; and the guide member is mounted to the lower deck and extends upward through the upper deck.

3. The facility according to claim 2, wherein the guide member has an upper end that is at a fixed distance from the upper deck and a lower end that is at a fixed distance below the upper deck.

4. The facility according to claim 2, wherein the said at least one set of guide rollers comprises an upper set of guide rollers located a fixed distance below the frame, and a set of lower guide rollers located a fixed distance below the upper set of guide rollers.

5. The facility according to claim 1, wherein the guide member has an upper end that is below the frame while the pistons and cylinders are in minimum stroke position.

6. The facility according to claim 1, wherein the guide roller support comprises a plurality of braces spaced circumferentially around the guide member, each of the braces extending parallel with an axis of the guide member.

7. The facility according to claim 1, wherein said at least one set of guide rollers comprises a lower set at a lower end of the roller guide support and an upper set positioned to engage the guide member near an upper end of the guide member while the pistons and cylinders are in a maximum stroke position.

8. A method of tensioning a riser extending from subsea equipment to a floating platform, which includes mounting a frame to the riser, and mounting pistons and cylinders between the platform and the frame, and supplying the cylinders with fluid pressure to apply tension to the riser, the improvement comprising:

(a) mounting a guide member to the platform;

(b) mounting a guide roller support to the frame, and mounting a set of guide rollers to the guide roller support and in rolling engagement with the guide member; and (c) in response to platform movement toward and away from the subsea equipment due to waves and/or current, moving the guide member in unison with the platform and relative to the guide roller support and set of guide rollers, which remain stationary with the riser.

9. The method according to claim 8, wherein step (a) further comprises extending the riser through the guide member.

* * * * *